United States Patent [19]

Hodge

[11] 4,182,530

[45] Jan. 8, 1980

[54] COMMERCIAL TRASH BIN LOCKING SYSTEM

[76] Inventor: Allan M. Hodge, 5852 Lomond Dr., San Diego, Calif. 92120

[21] Appl. No.: 898,382

[22] Filed: Apr. 20, 1978

[51] Int. Cl.[2] ..... B65F 1/00

[52] U.S. Cl. ..... 294/73; 220/1 T; 220/210; 220/326; 292/228; 292/281; 292/288; 414/411

[58] Field of Search ..... 294/68, 69 R, 73; 214/302-304, 307, 317; 220/1 T, 210, 326; 292/126, 128, 226, 228, 230, 231, 281-288

[56] References Cited

U.S. PATENT DOCUMENTS

| | | | |
|---|---|---|---|
| 2,730,253 | 1/1956 | Oswalt | 214/307 X |
| 2,830,839 | 4/1958 | Ferguson | 292/281 |
| 3,137,408 | 6/1964 | Taylor | 220/326 |
| 3,687,317 | 8/1972 | Gagel | 214/304 |
| 3,828,899 | 8/1974 | Scott | 292/231 X |
| 4,088,071 | 5/1978 | Cruse et al. | 294/73 X |

*Primary Examiner*—Johnny D. Cherry

*Attorney, Agent, or Firm*—Poms, Smith, Lande & Rose

[57] ABSTRACT

A commercial trash bin is provided with locking arrangements which restrict the use of the trash bin to the authorized user thereof, and still permit the dumping of the trash bins without wasting any extra time by the garbage truck operator. The lids are provided with a special latch which is disabled to permit dumping through gravity action when the trash bin is lifted and inverted and dumped. In one case the mechanism includes a heavy spring which is compressed by the weight of the trash bin, and in another case a gravity operated latch releasing mechanism is employed. In each case, to open the trash bin while it is in the upright orientation, a key-operated release, either in the form of a padlock or a built-in lock mechanism, is used.

14 Claims, 7 Drawing Figures

COMMERCIAL TRASH BIN LOCKING SYSTEM

FIELD OF THE INVENTION

This invention relates to commercial trash bin systems.

BACKGROUND OF THE INVENTION

Particularly where trash bins are located in alleys where there is heavy traffic and many persons having a need to dispose of waste material, the person who pays for leasing the trash bins often finds that other unauthorized persons are disposing of their trash and precluding him from having full use of the facilities which he has rented. While it might be logical to provide a lock and key for trash bins, the delay which would be involved with the garbage collectors having to tediously unlock each trash bin, when combined with the high rental cost of garbage trucks, has effectively precluded such a solution to the problem, up to the present time.

Accordingly, a principal object of the present invention is to restrict the use of commercial trash bins to authorized users, while not impeding or slowing down the garbage collection process from such commercial trash bins.

SUMMARY OF THE INVENTION

In accordance with the present invention, a commercial trash bin is provided with locking arrangements which can be released in either of two ways: (1) by the use of a key when the authorized user of the trash bin wishes to deposit trash in the bin, when the bin is in the upright orientation, and (2) by gravity-operated latch releasing arrangements which automatically come into play when the commercial trash bin is released and dumped in normal operation by a garbage truck.

In one specific embodiment, the locking means includes a very heavy spring, and the latch is disabled by the compression of this spring when the weight of the trash bin rests on the latch as the trash bin is being raised and inverted for dumping.

In another embodiment, the latch releasing mechanism is operated by gravity to permit the opening of the lid when the trash bin is inverted.

Other objects, features, and advantages of the invention will become apparent from a consideration of the following detailed description and the accompanying drawings.

DETAILED DESCRIPTION

Figure 1:
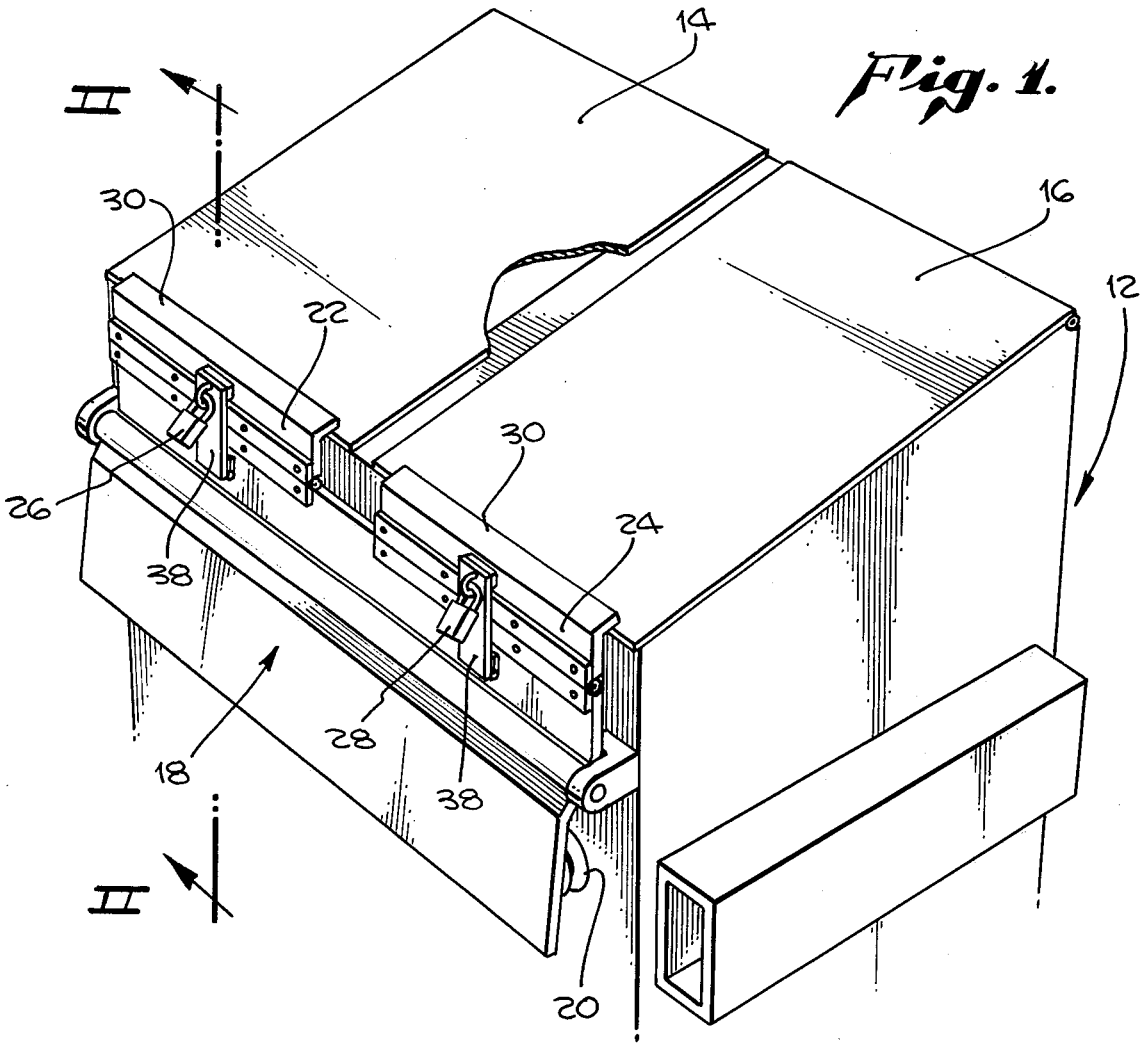
FIG. 1 is a isometric view of a first embodiment of the locking commercial trash bin system of the present invention.

Referring more specifically to the drawings, FIG. 1 shows a commercial trash bin 12 provided with two lids 14 and 16. A latch mechanism 18 includes a number of parts to be discussed in greater detail below. Visible in FIG. 1, however, is one of the heavy springs 20 which forces the locking members 22 and 24 over the outer edges of the lids 14 and 16, respectively, so that they may not be opened as long as the heavy springs, including spring 20, are not compressed, or the padlocks 26 and 28 are not opened.

Figure 2:
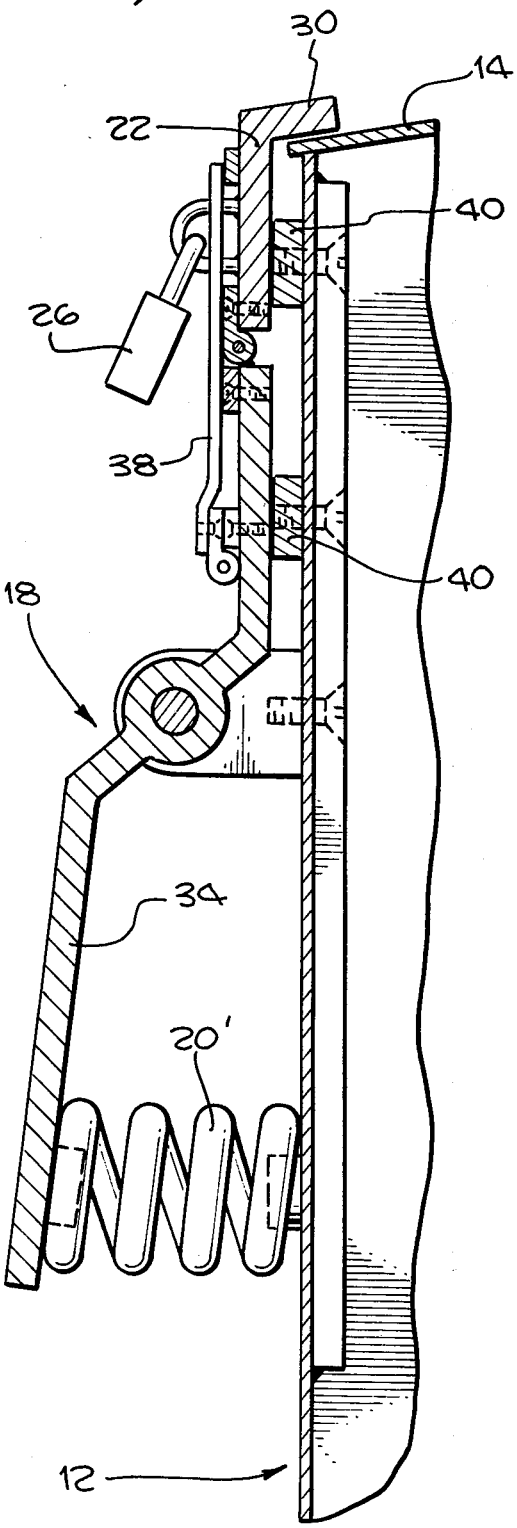
FIG. 2 is a cross-sectional view taken along lines II—II of FIG. 1.

Referring to FIG. 2, it may be seen that the lid 14 is held down firmly onto the trash bin 12 by the latch mechanism 18 including the heavy spring 20′ which exerts a heavy force to hold the upper end 30 of the latch mechanism 18 into position above the outer edge of the lid 14.

Figure 3:
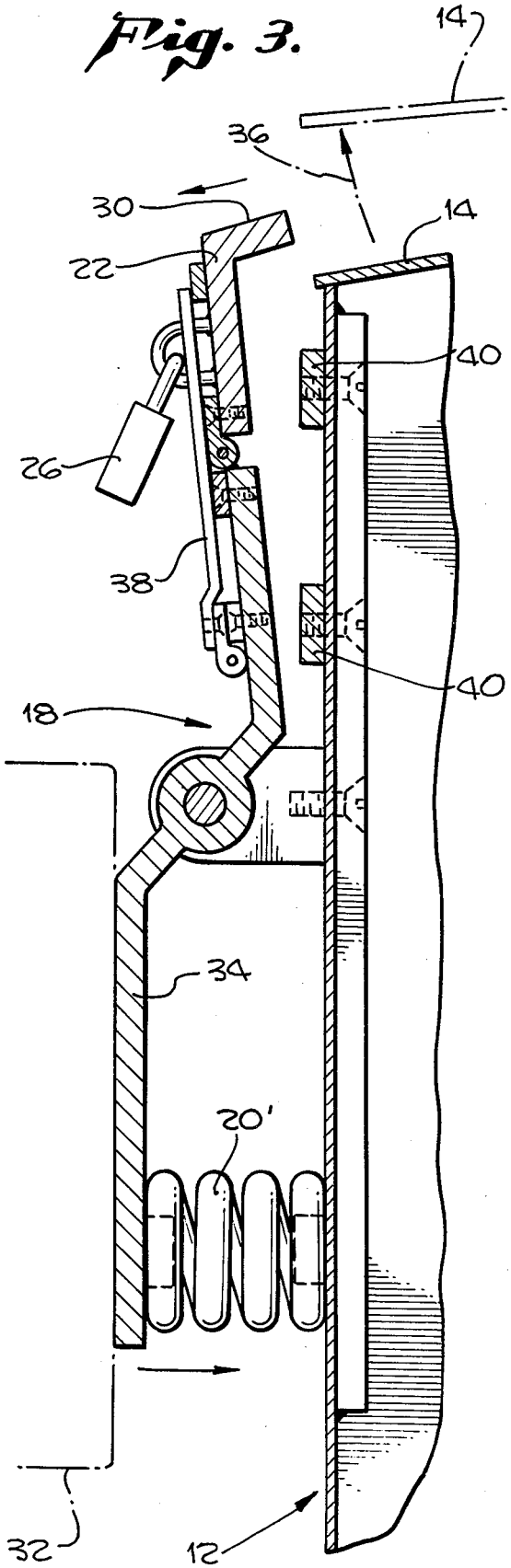
FIG. 3 is a view similar to that of FIG. 2, but showing the latch in the released position when the latch and spring mechanism is compressed by the weight of the trash bin.

FIG. 3 shows a portion of the truck 32 engaging the broad lower portion 34 of the latch assembly 18, compressing the heavy coil spring 20′. This moves the upper end 30 of the latch mechanism out of its overlying relationship with regard to the lid 14 which may move away from the bin 12 as indicated by the arrow 36. Of course, FIG. 3 should actually be shown 90° or more tilted from the showing of FIG. 2, because it is the weight of the trash bin 12 on the truck support member 32 which causes the compression of the coil spring 20′, thereby permitting the lid 14 to swing open for easy dumping.

It is also noted, as one of the important features of the present invention, that no additional time is required on behalf of the garbage truck operator to unlock or otherwise be cognizant of the existence of the locking mechanism 18.

Figure 4:
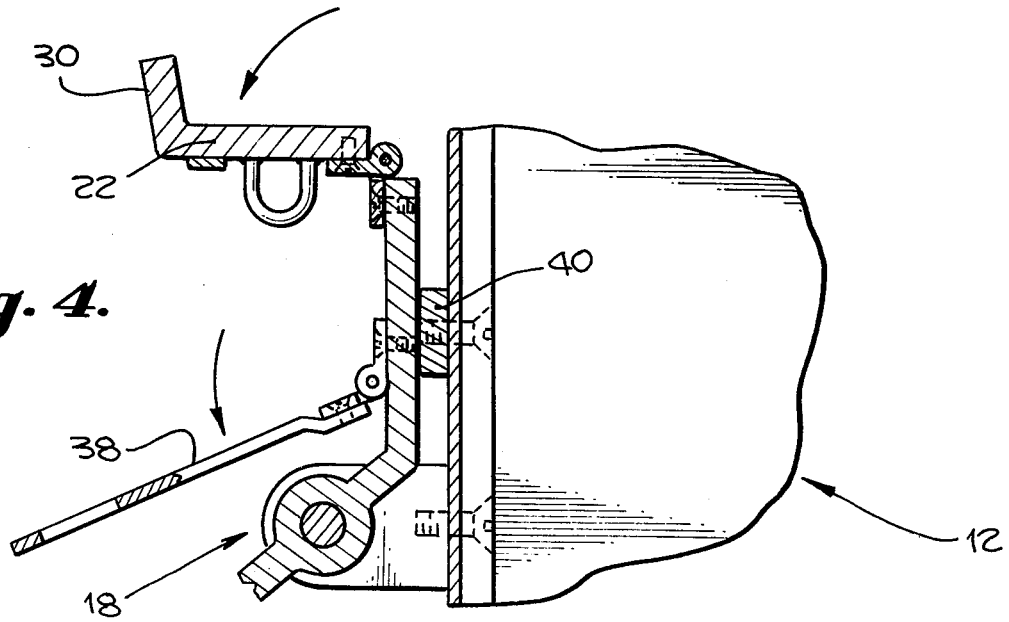
FIG. 4 is a detail showing the release of the latch while the trash bins are in the upright position.

FIG. 4 by comparison with FIG. 2 shows the release of the latch 18 by the user through unlocking one of the padlocks 26 or 28. With the padlock removed, the hasp 38 may be pivoted back, and the L-shaped member 22 with its locking lip 30 may also be pivoted so that the lid 14 may be raised and garbage dumped into the commercial trash bin. The stop 40 receives the full force of the heavy coil spring 20 and 20′, and thus permits the pivoting back of the upper portion 22 of the latch mechanism without interference of the heavy springs.

Figure 5:
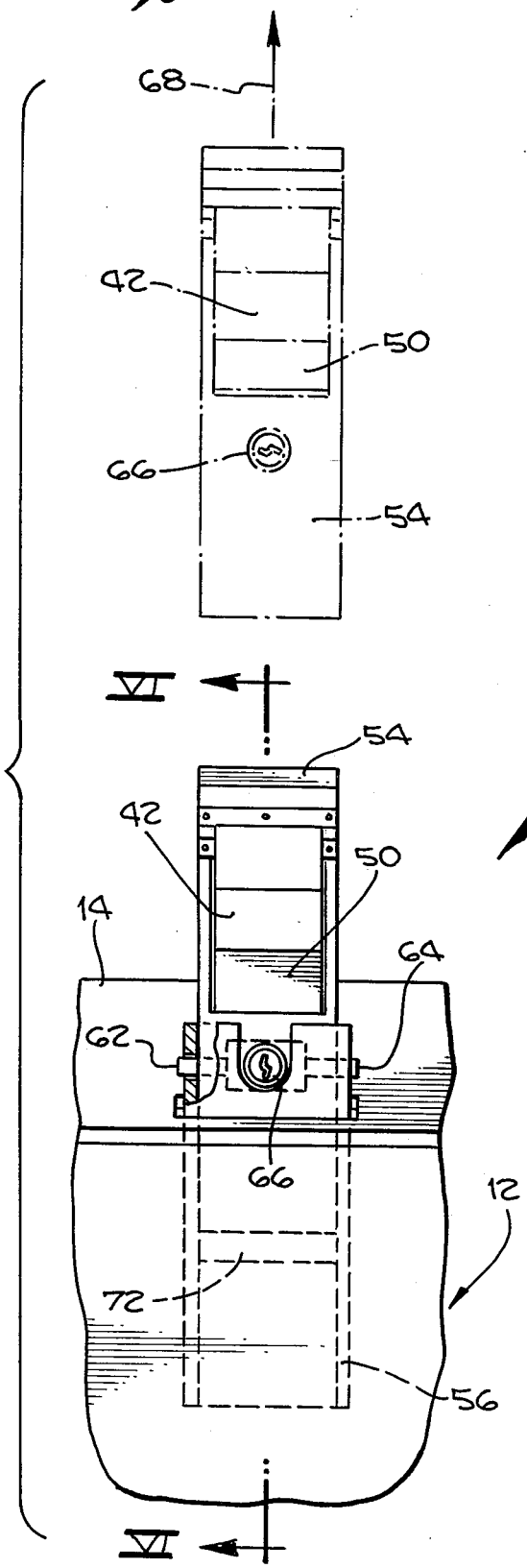
FIG. 5 shows an alternative embodiment of the invention showing an important locking element, both in position and raised to the unlocking position.
Figure 7:
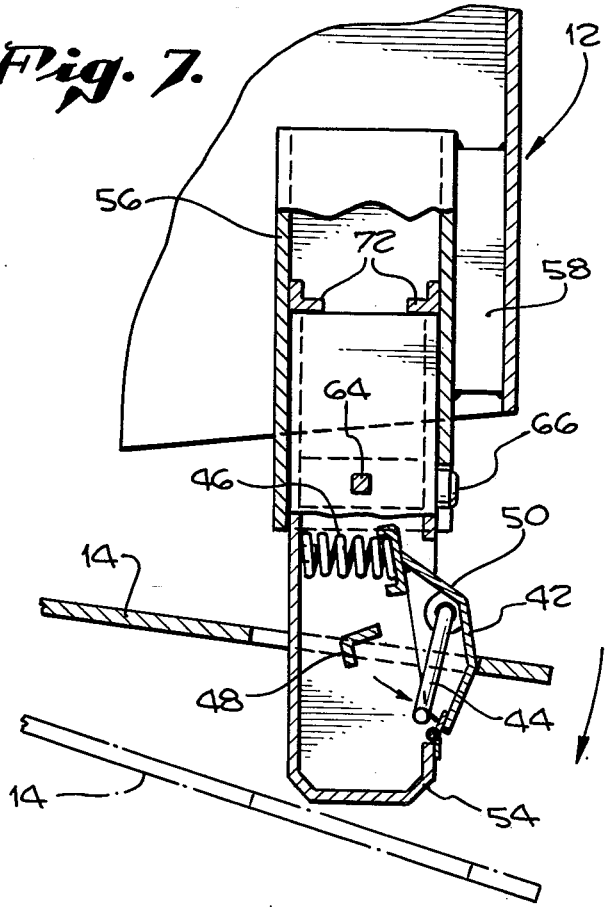
FIG. 7 shows the mechanism of FIGS. 5 and 6 in the unlatched position permitting the automatic opening of the trash bin lid.
Figure 6:
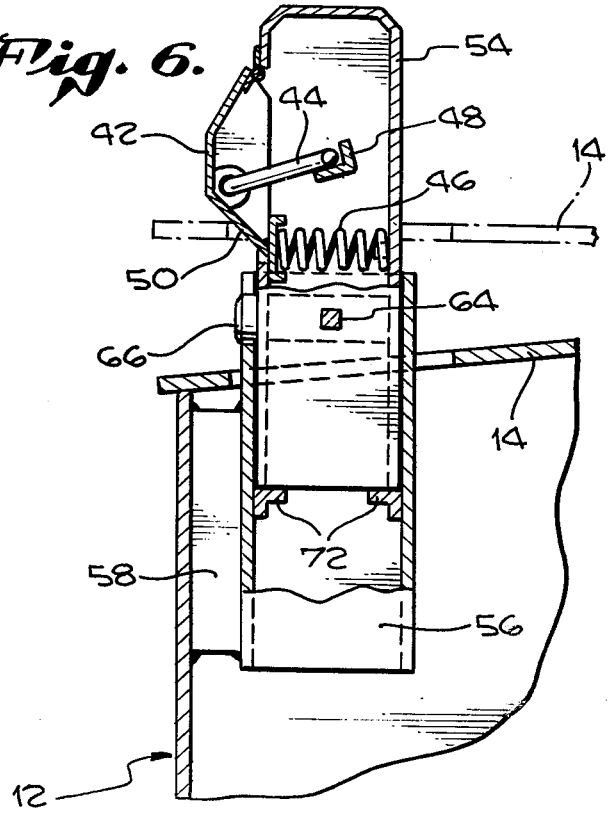
FIG. 6 is a cross-sectional view taken along VI—VI of FIG. 5.

The arrangement of FIGS. 5 through 7 is an alternative to that disclosed in FIGS. 1 through 4, and it accomplishes substantially the same function. As best shown in FIG. 6, the lid 14 is normally restrained from significant movement away from the top of trash bin 12 by the obstruction provided by latch 42. Thus, in the dash line showing of the lid 14 in FIG. 6, it cannot be raised beyond the indicated position because the latch detent 44 prevents movement of the latch 42 against the biasing force of spring 46 in view of the positive stop provided by the element 48, which is of L-shaped cross section.

As shown in FIG. 7, however, when the trash bin 12 is inverted for dumping, the latch restraining detent 44 falls down to the indicated position away from the stop 48 and the lid 14 presses on the angled surface 50 of the latch 42, compressing spring 46, and permitting the lid 14 to swing past the latch 42.

Incidentally, the housing 54 which provides a support for the L-shaped stop member 48 and the other mechanisms described above, is removable from the enclosing support 56 which is welded to the inside of the trash bin 12 through a reinforcing member 58. The removable member 54 is normally held in position by the key actuated bolts 62 and 64 (see FIG. 5) which extend outwardly from the removable member 54 through the walls of the enclosing rectangular housing 56. However, upon insertion of a key into the lock 66, the bolts 62 and 64 may be retracted so that the latch mechanism 54 may be raised in its entirety, thereby permitting easy raising of the lid 14 for the deposit of trash, by the authorized user. The dash-dot line showing and the arrow 68 in FIG. 5 indicates the removal of the assembly 54 as described above.

The support members 72 within the outer rectangular housing 56 serve to locate the removable latch mechanism 54 at the proper depth so that the bolts, 62, 64 will make easy engagement with the mating openings in the enclosing housing 56.

Incidentally, the key actuated locking mechanisms including the padlocks could be provided with other types of security arrangements for unlocking them, such as combination lock releases, or coded magnetic releases, for example.

It is to be specifically understood that the two embodiments described herein are merely illustrative of the general principles of the invention. Other mechanical arrangements to implement the functions described herein are within the scope of the present invention. By way of specific example but not of limitation, certain lid and trash bin assemblies operate in accordance with a first mode of operation with the lid following a first predetermined movement pattern in the upright position, and operate in another mode and pattern of movement when they are being dumped (see U.S. Pat. No. 3,994,415, for example); and a removable locking mechanism or stop blocking only the first mode or pattern of movement would also be within the scope of the present invention.

What is claimed is:

1. A locking trash bin assembly comprising:

a commercial trash bin;

at least one lid mounted on said trash bin;

locking means for normally preventing the opening of said lid when said trash bin is in the upright orientation;

means for disabling said locking means and permitting said lid or lids to swing open when said trash bin is dumped;

means for unlocking said locking means to permit the opening of said lid or lids when the trash bin is in the upright orientation; and means for permitting authorized users only to operate said unlocking means and for preventing unauthorized users from operating said unlocking means when said trash bin is in the upright orientation, whereby the authorized users of said trash bin have exclusive access to deposit trash in said bin, and there is no delay in the normal dumping of said trash bin.

2. A locking trash bin assembly as defined in claim 1, wherein said disabling means includes gravity operated means for permitting said lid of lids to open when said trash bin is being dumped.

3. A locking trash bin assembly as defined in claim 1, wherein said locking means includes a latch holding said lid or lids closed, a spring engaging a portion of said latch and biasing said latch to the latching position, and means for compressing said spring and releasing said latch by the application of the weight of at least a portion of said assembly to compress said spring as said bin is raised and rotated for dumping.

4. A locking trash bin assembly as defined in claim 3 wherein said spring is a heavy duty spring, whereby it may not easily be operated manually.

5. A locking trash bin assembly as defined in claim 3 wherein said latch includes a gravity operated latch detent and a lid engaging portion, and wherein means are provided for pivotally mounting said latch detent between said lid engaging portion of said latch and the portion of said latch engaged by said spring.

6. A locking trash bin assembly as defined in claim 1, further including means secured to said bin for facilitating raising and dumping said bin.

7. A locking trash bin assembly as defined in claim 6 wherein said means secured to said bin for facilitating raising and dumping said bin constitutes pocket tubes secured to the sides of said bin.

8. A locking trash bin assembly as defined in claim 1 wherein said locking means and said disabling means includes gravity actuated detent means for normally preventing opening of said lid, or lids, and means for mounting said detent means for movement as said bin is turned upside down for dumping to permit said lid to fully open.

9. A locking trash bin assembly as defined in claim 1 wherein a first pivoted member is provided for engaging the lid or lids, spring means are provided for biasing said first pivoted member into a locking position with respect to said lid or lids, and gravity actuated detent means are provided for locking said first pivoted member against movement when said trash bin is in the upright position and for permitting said lid or lids to swing past said pivoted member when said bin is inverted for dumping.

10. A locking trash bin assembly as defined in claim 1 wherein said unlocking means includes means for removing said locking means from said assembly, thereby permitting the lid or lids to be opened while the bin is in the upright orientation.

11. A locking trash bin assembly comprising:

a commercial trash bin;

a lid or lids mounted on said trash bin;

locking means for normally preventing the opening of said lid or lids when said trash bin is in the upright orientation;

means for disabling said locking means and permitting said lid or lids to swing open when said trash bin is dumped; and means for unlocking said locking means to permit the opening of said lid or lids when the trash bin is in the upright orientation, said unlocking means includes security means for releasing said locking means and permitting the authorized user only to deposit trash in said bin, whereby the authorized users of said trash bin have exclusive access to deposit trash in said bin, and there is no delay in the normal dumping of said trash bin.

12. A locking trash bin assembly as defined in claim 11 wherein said unlocking means comprises means for removing said locking means from said assembly, thereby permitting the the lid or lids to be opened while said bin is in the upright position.

13. A trash bin assembly including a commercial trash bin and a lid or lids mounted on said trash bin, the improvement comprising:

locking means for normally preventing the opening of said lid or lids by unauthorized persons when said trash bin is in the upright orientation;

means for disabling said locking means and permitting said lid to swing open when said trash bin is dumped; and means operable only by authorized persons for unlocking said locking means to permit the opening of said lid when the trash bin is in the upright orientation; whereby the authorized users of said trash bin have exclusive access to deposit trash in said bin, and there is no delay in the normal dumping of said trash bin.

14. A trash bin assembly including a commercial trash bin and a lid or lids mounted on said trash bin, the improvements comprising:

locking means for normally preventing the opening of said lid or lids by unauthorized persons when said trash bin is in the normal upright orientation resting on a supporting surface;

means for disabling said locking means and permitting said lid to swing open when said trsh bin is dumped; and means operable only by authorized persons for unlocking said locking means to permit the opening of said lid when the trash bin is in the upright orientation; whereby the authorized users of said trash bin have exclusive access to deposit trash in said bin, and there is no delay in the normal dumping of said trash bin.

* * * * *